US006313803B1

(12) United States Patent
Manasson et al.

(10) Patent No.: US 6,313,803 B1
(45) Date of Patent: Nov. 6, 2001

(54) MONOLITHIC MILLIMETER-WAVE BEAM-STEERING ANTENNA

(75) Inventors: Valadimir Manasson, Los Angeles; Lev Sadovnik, Irvine, both of CA (US)

(73) Assignee: Waveband Corporation, Torrance, CA (US)

( * ) Notice: Subject to any disclaimer, the term of this patent is extended or adjusted under 35 U.S.C. 154(b) by 0 days.

(21) Appl. No.: 09/479,342

(22) Filed: Jan. 7, 2000

(51) Int. Cl.[7] ..... H01Q 19/00
(52) U.S. Cl. ..... 343/756; 343/909
(58) Field of Search ..... 343/756, 785, 343/909, 912; 385/9; 287/80; 350/96.13; H01Q 19/00

(56) References Cited

U.S. PATENT DOCUMENTS 3,628,184 * 12/1971 Thompson ..... 331/107 S
4,079,404 * 3/1978 Comerford ..... 357/19
4,867,515 * 9/1989 Normandin ..... 350/96
5,323,024 * 6/1994 Adams ..... 257/80
5,796,881 * 8/1998 Manasson et al. ..... 385/9
5,982,334 11/1999 Manasson et al. ..... 343/785

* cited by examiner

*Primary Examiner*—Don Wong
*Assistant Examiner*—Shih-Chao Chen
(74) *Attorney, Agent, or Firm*—Herbert M. Shapiro

(57) ABSTRACT

The addition of semiconductor spacers into the spaces between the metal strips of a metal grid permits electron-hole plasmas to be introduced there controllably. Thus, the grid can be made to transmit or reflect an incident wave with a polarization perpendicular to the strips depending on whether or not the spacers are filled with minority carriers. The presence of carriers may be controlled electrically, optically and by field effect means which permit the basic metal strip/semiconductor structure (MGSS) to operate as a reconfigurable hologram, a reflector, a phase shifter, a switch, and a beam-steering antenna.

28 Claims, 12 Drawing Sheets

MONOLITHIC MILLIMETER-WAVE BEAM-STEERING ANTENNA

FIELD OF THE INVENTION

This invention relates to millimeter-wave (MMW) beam steering antennas and more particularly to such antennas which include switching and steering components which along with the antennas can be integrated into a monolithic structure.

BACKGROUND OF THE INVENTION

Electronically-controlled MMW beam-steering antennas the operation of which is based on the interaction of millimeter waves with solid-state plasmas in a planar semiconductor waveguide was disclosed in our paper entitled Monolithic Electronically-Controlled Millimeter-Wave Beam-Steering Antenna. The paper was delivered at the Topical Meeting on Silicon Monolithic Integrated Circuits in R.F. Systems, Sep. 17–18 1998, Ann Arbor, Mich., sponsored by the IEEE Microwave Theory and Techniques Society, NASA Lewis Research Center, Jet Propulsion Laboratory and Army Reserve Office.

The paper describes the need for a beam-steering antenna for a variety of applications such as automobile intelligent control and all-weather aircraft landing and notes that one of the most expensive components of systems suitable for such applications is the beam-steering antenna which performs sensor functions. The existing phased-array technology for electronic beam-steering does not meet the required compactness and cost efficiency criteria. The paper discloses a solid state antenna based on a reconfigurable plasma grating formed in a planar waveguide which performs beam-steering functions at MMW frequencies employing carrier injection to excite the required patterns.

The antenna disclosed in that paper comprises a silicon planar waveguide with an array of two-hundred PIN cells. All the cells have a common bottom ground electrode (N+type) and separate upper electrodes (P+type), the latter controllably connectable to a current source. The activated cells (pixels) are organized to create a periodic pattern of activated pixels which provides a plasma grating which operates as an amplitude deffraction grating for millimeter waves. A dielectric rod waveguide, set at a tunnel distance from the silicon substrate, is used as an antenna feeder.

BRIEF DESCRIPTION OF THE INVENTION

In accordance with the principles of this invention an array of parallel, thin metal strips are formed on the surface of a semiconductor substrate to form a metal grid semiconductor structure (MGSS) where the width of each strip is smaller than the wavelength of a wave propagating through the semiconductor substrate and the gap between the strips is smaller than the width of a strip.

The structure has two modes of operation, the first when there are no carriers between strips; the second when the gaps are filled with carriers. In the absence of carriers, the structure is operative as a grid polarizer. When an incident wave has an electric vector parallel to the strips, the wave induces current within the strips. The current generates a secondary wave which interferes with the incident wave resulting in almost total reflection of the incident wave. When the incident wave has an electric vector perpendicular to the strips, due to the small size of the strips in this direction, the current induced by the incident wave is small and the grid has very little affect on the incident wave.

The injection of carriers between the strips provides conductivity in a direction perpendicular to the strips. Any incident wave with any polarization induces current in the strips and is reflected by the structure so long as carriers are present between the strips. The carriers can be injected illustratively, by illumination, by injection from P-and N-electrodes beneath the strips and by using field effects.

If a MGSS is used with a planar dielectric waveguide, a mechanism for phase control is provided where the presence of a conducting imaging surface imposed by an active MGSS changes the mode structure in the waveguide. Mode switching is accompanied by a corresponding change in phase velocity.

The carriers can be injected into the space between metal strips individually to provide a basic element in, for example, a reconfigurable MMW hologram, a controlled reflector, a switch, a phase shifter, as well as a beam steering device.

DETAILED DESCRIPTION OF ILLUSTRATIVE EMBODIMENTS OF THIS INVENTION

Figure 1:
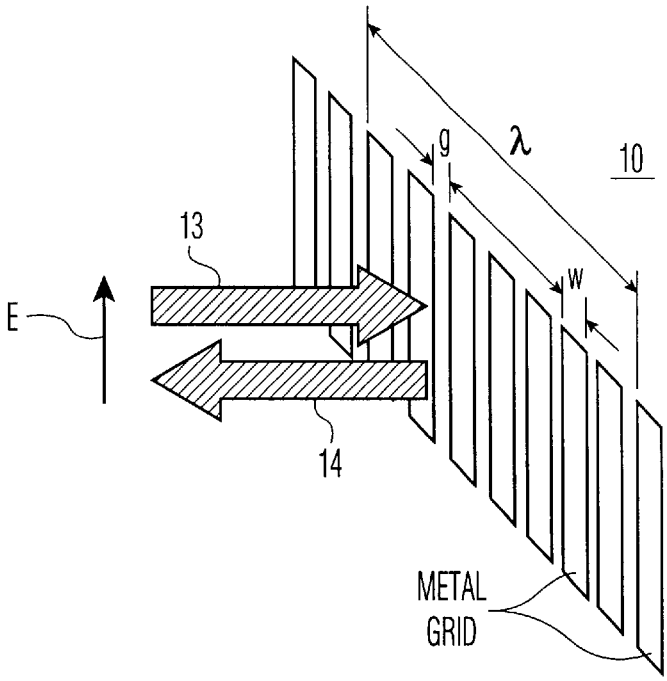
FIG. 1 PRIOR ART
FIGS. 1 and 2 are schematic representations of a prior art metal grid polarizer.
Figure 2:
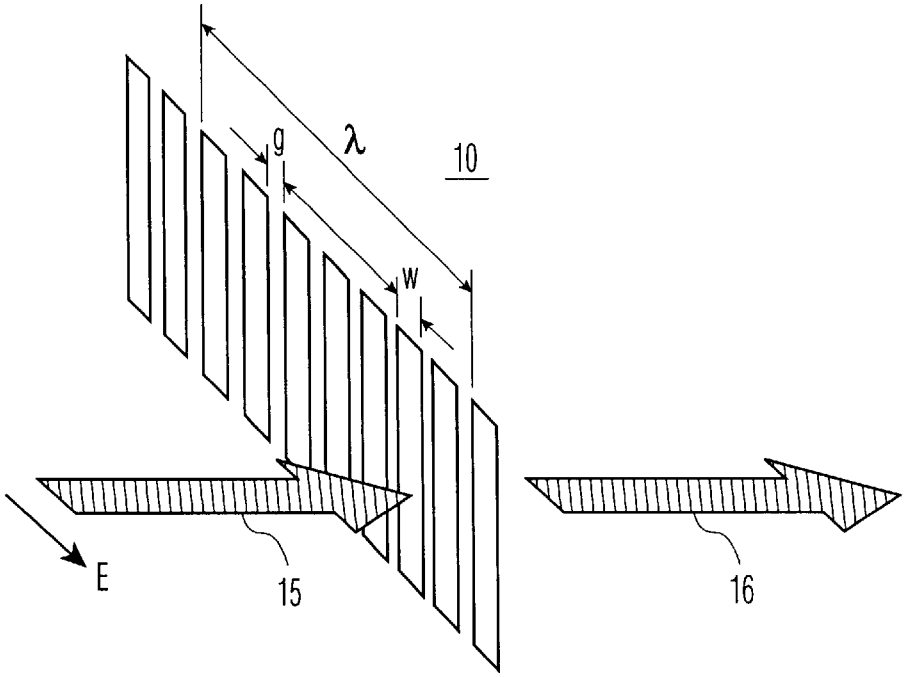
FIG. 2 PRIOR ART

FIGS. 1 and 2 show, schematically, an array of parallel, spaced apart metal strips forming a grid 10. The grid operates to reflect incident waves with polarization parallel to the metal strips and to transmit waves with polarization perpendicular to the metal strips. The parallel polarization mode is represented in FIG. 1 by arrows 13 and 14, the electric vector of which is represented by arrow E. The perpendicular mode is represented in FIG. 2 by arrows 15 and 16, the electric vector of which is represented by arrow E. A characteristic of the metal grid polarizer is that the width of a strip (W) and the spacing (g) between the strips is much smaller than the wavelength (λ) of the input wave.

Figure 3:
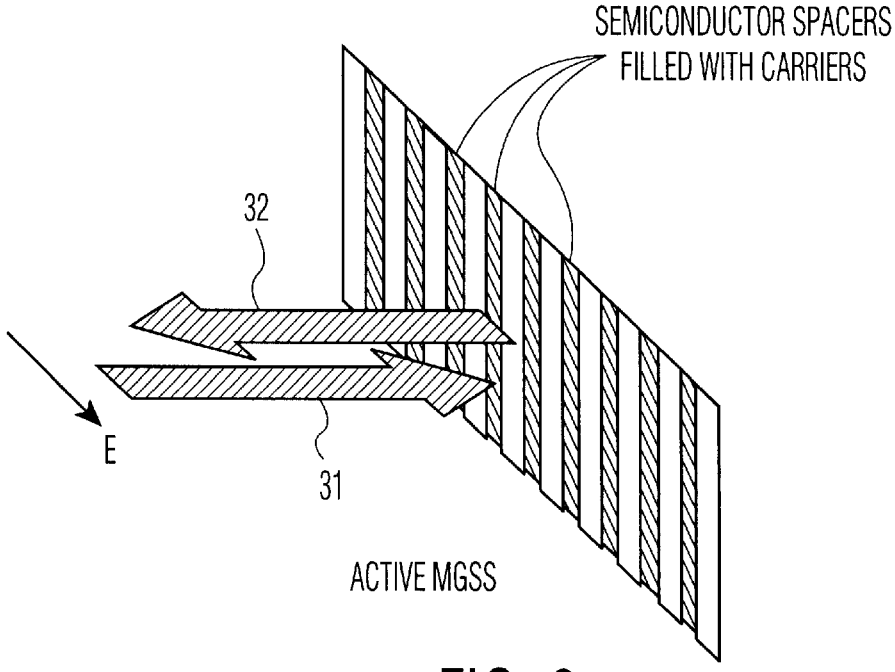
FIGS. 3 and 4 are schematic representations of a metal grid/semiconductor structure (MGSS) in accordance with the principles of this invention.
Figure 4:
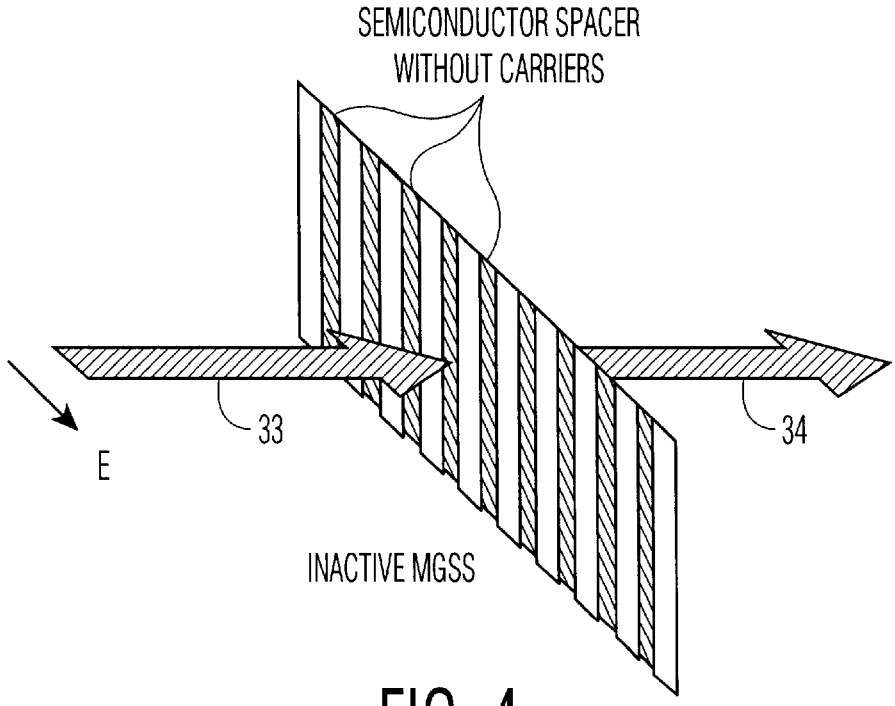

FIGS. 3 and 4 illustrate the metal grid of FIGS. 1 and 2 with semiconductor spaces between the strips in accordance with the principles of this invention. FIG. 3 illustrates an active mode for the device where the input wave has a polarization perpendicular to the strip width but the spaces are filled with minority carriers. The input wave is reflected as indicated by the oppositely-directed arrows 31 and 32. FIG. 4 illustrates the inactive mode where the carriers are absent from the spaces. The input wave is transmitted as indicated by arrows 33 and 34. The presence of semiconductor spaces between the strips of a metal grid, in accordance with the principles of this invention, provides a means for controlling the transmission or reflection of an incident wave with a polarization perpendicular to the metal strips.

Figure 5:
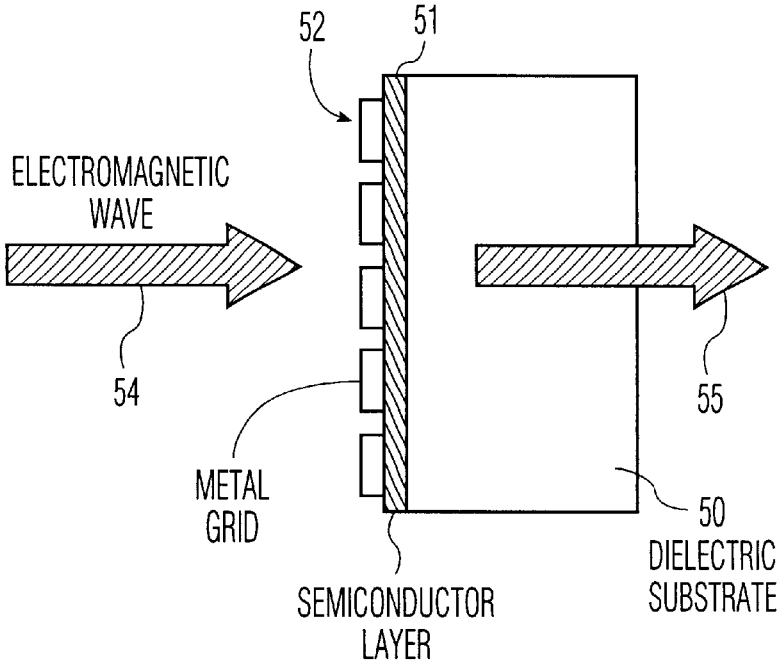
FIGS. 5, 6, and FIGS. 7 and 8 are schematic side views of various embodiments employing an MGSS which are optically controlled.
Figure 6:
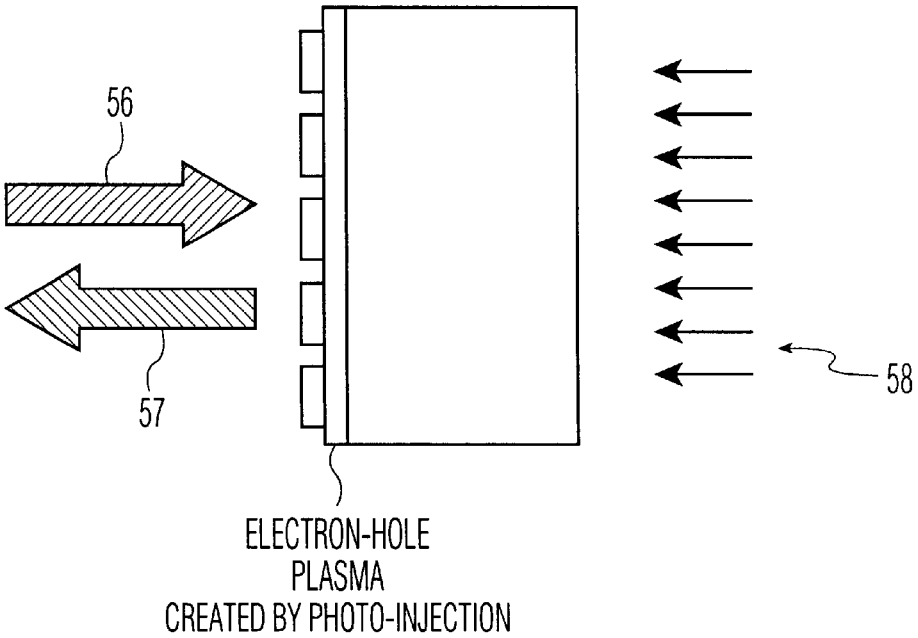

FIGS. 5 and 6 illustrate an optical control means for selectively filling the semiconductor spaces of FIGS. 3 and 4 with carriers. Specifically, the embodiment of FIGS. 5 and 6 comprise a dielectric substrate 50 such as quartz with a semiconductor surface layer 51 of silicon. The metal grid 52 is formed on the surface of the semiconductor layer. The electromagnetic input wave is shown transmitted by arrows 54 and 55 in FIG. 5 and reflected as represented by the oppositely directed arrows 56 and 57 in FIG. 6. FIG. 6 also shows the presence of pumping light (arrows 58) to produce an electron-hole plasma (carriers) in layer 51.

Figure 7:
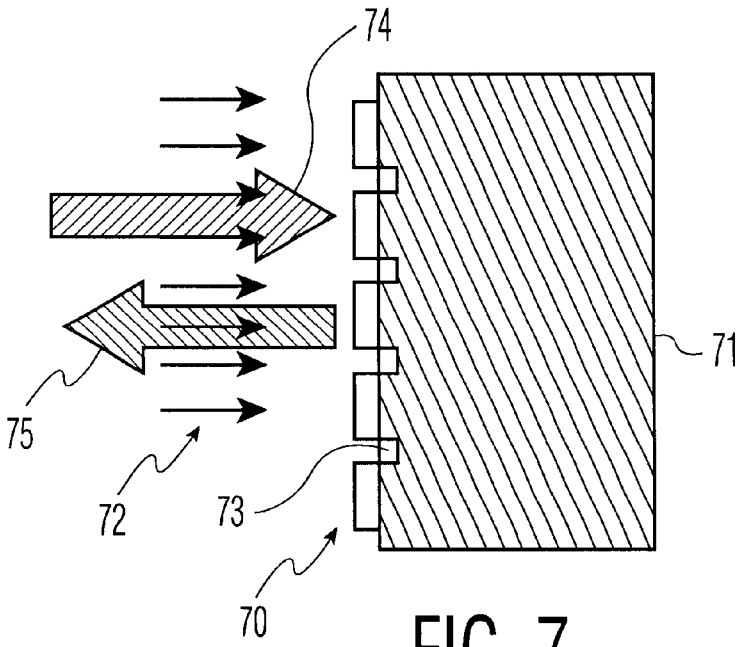

FIG. 7 illustrates an alternative embodiment with optical control. In this embodiment, the metal grid 70 is formed on a high resistivity (ten-thousand ohm centimeters) semiconductor wafer 71 and the pumping light is directed at the grid as indicated by arrows 72. In the presence of pumping light, an electron-hole plasma is created by photo injection in the spacings 73 between the strips of the grid and the incident electromagnetic wave is reflected as indicated by the oppositely directed arrows 74 and 75. In the absence of pumping light, the electromagnetic wave is transmitted through the MGSS. In the embodiments of FIG. 7 or FIGS. 5 or 6 the pumping light may be provided by any source capable of generating an electron-hole plasma and conveniently comprises a-semi-conductor laser bar (λ=0.94 microns).

Figure 8:
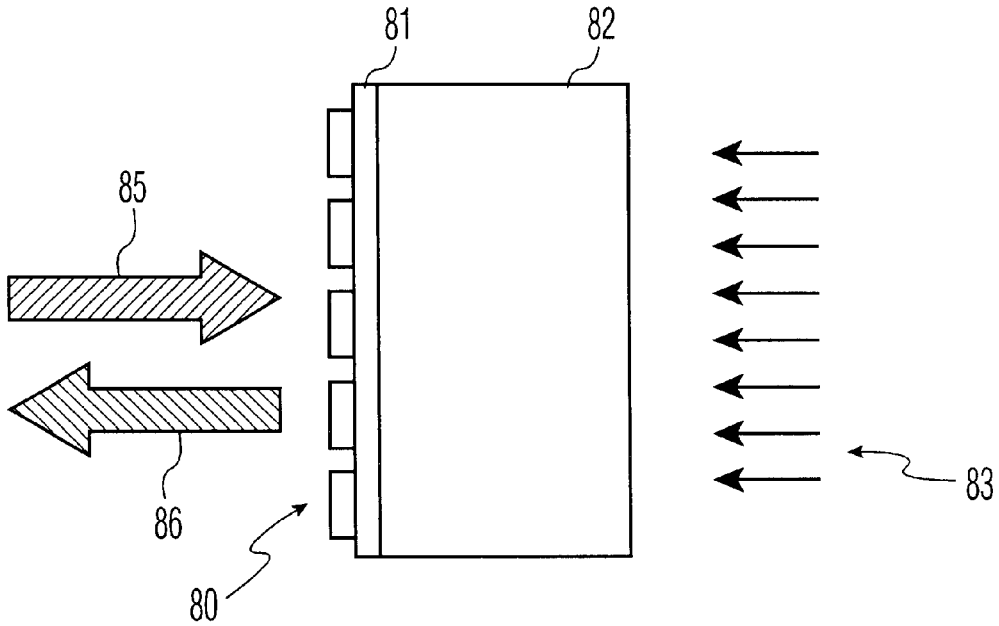

FIG. 8 illustrates an alternative embodiment with optical control of plasma generation using a semi conductor heterojunction. Specifically, FIG. 8 illustrates a metal grid 80 on a narrow band semiconductor layer 81 formed on the surface of a wide band semiconductor substrate 82. Illustratively, layer 81 comprises $G_a$ $A_s$ and substrate 82 comprises $G_a$ Al $A_s$. Pumping light shown directed from the right as viewed in FIG. 8 (arrows 83) create an electron-hole plasma in layer 81 which causes the grid to reflect an incident electromagnetic wave as indicated by the oppositely-directed arrows 85 and 86. In the absence of pumping light, the wave is transmitted. It is also possible to illuminate each space between adjacent strips individually.

Figure 9:
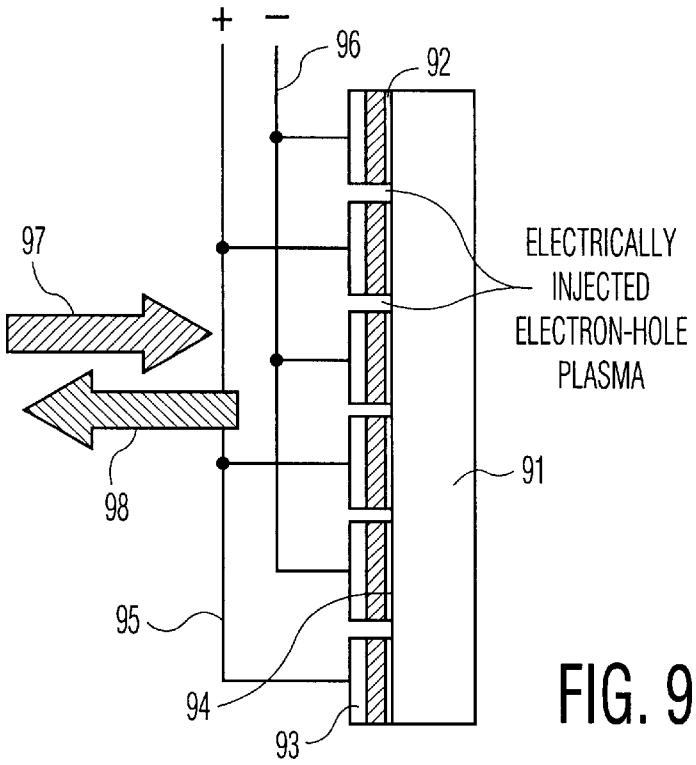
FIGS. 9, 10, 11 and 12 are schematic side views of various embodiments employing an MGSS which are electrically controlled.

FIG. 9 illustrates an embodiment employing electrical controls for introducing an electron-hole plasma. Specifically, FIG. 9 shows a dielectric substrate 91, semiconductor surface layer 92 and heavily-doped P+and N+electrodes 93 and 94. Electrical conductors 95 and 96 are connected to the P+electrodes and the N+electrodes respectively and to a power supply (not shown). A forward bias, indicated by the plus and minus signs, causes electron hole injection which connects the metal strips of a grid which overly the electrodes. An incident electromagnetic wave is reflected as indicated by the oppositely directed arrows 97 and 98.

In the absence of a bias or with a reverse bias on conductors 95 and 96, no electron-hole plasma is present and the incoming wave is transmitted.

Figure 10:
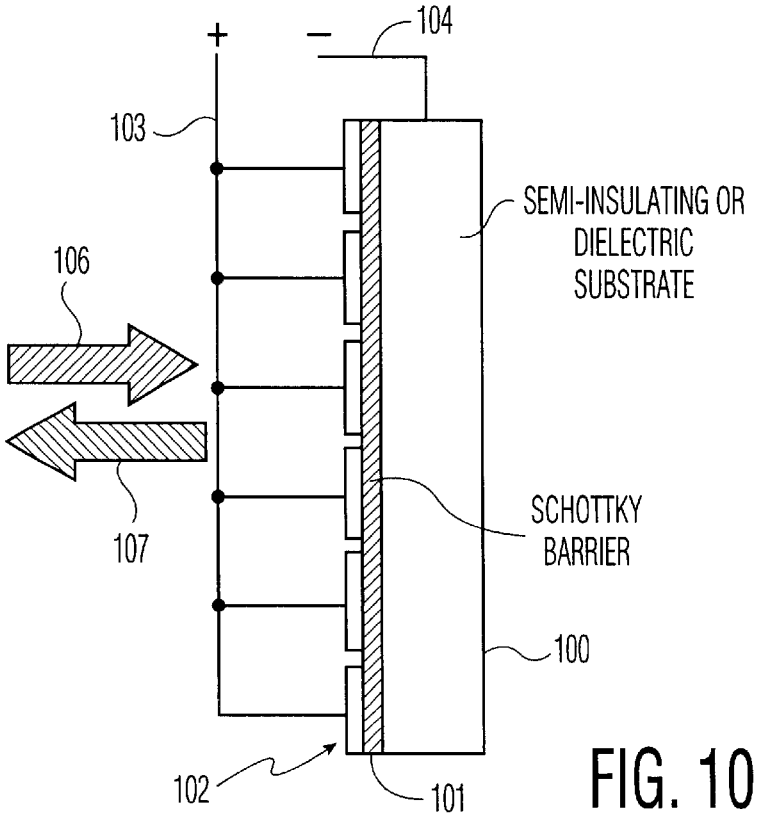

FIG. 10 shows an embodiment where the electrical controls are implemented with Schottky barriers and depletion layers. The embodiment includes a high resistance semiconductor substrate 100 with a moderately-doped N or P layer 101 and a metal grid 102. Parallel electrical contacts are made to the grid as shown by conductor 103 and by conductor 104 connected to the substrate. Schottky barriers are formed at the interface between the strips of the metal grid and layer 101. In the absence of a bias, doped layer 101 connects the metal strips and an incident wave is reflected as indicated by arrows 106 and 107.

In the presence of a reverse bias, indicated by the plus and minus signs 108 and 109 respectively, carrier depletion areas are present in layer 101 between the metal strips. The depletion areas operate to disconnect the strips.

Figure 11:
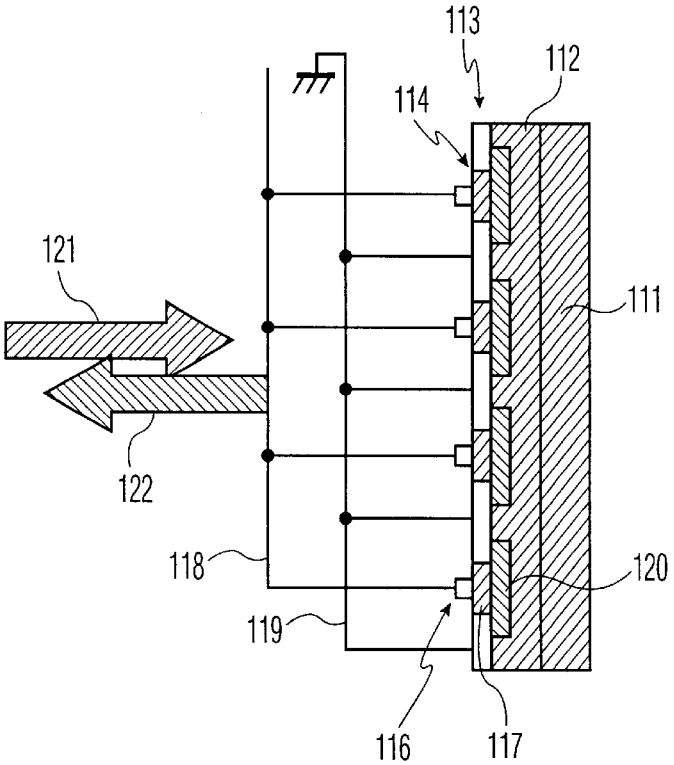
Figure 12:
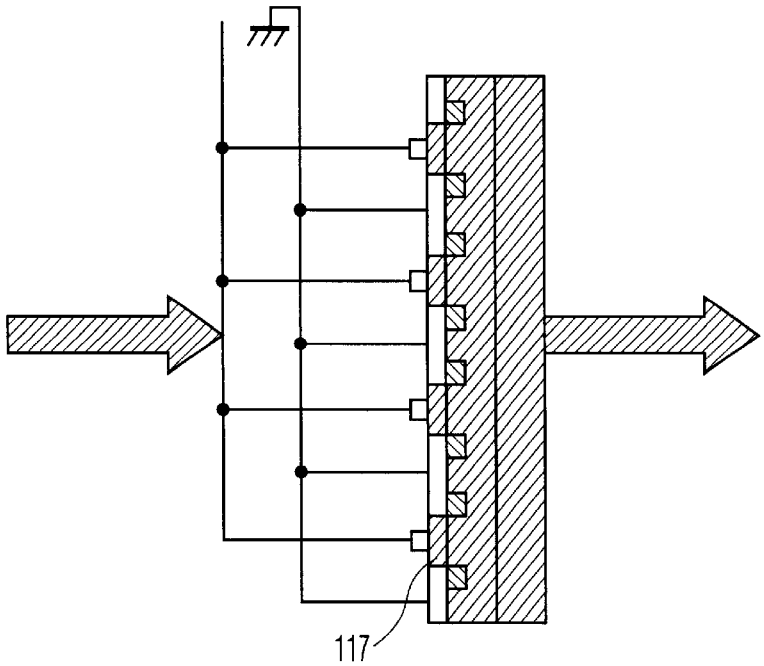

FIG. 11 shows an embodiment where electrical control is implemented with field effect transistors. The embodiment includes a high resistance semiconductor substrate 111 with a surface semiconductor layer 112 and a grid 113 comprising the characteristic array of spaced-apart strips separated by dielectric spacers 114. Control gates 116 are formed on the spacers. Doped electrode areas 117 are formed in layer 112 beneath the ends of the strips. Electrical conductor 118 is connected to the gates and electrical conductor 119 is connected to the strips of the grid. A voltage is applied to conductor 118 to open a channel 120 between adjacent doped electrode areas 117 thus providing an electron-hole plasma between the strips. An incident wave is reflected as indicated by the oppositely-poled arrows 121 and 122. In the absence of a voltage, channels 120 are absent and an incident wave is transmitted as represented in FIG. 12.

In the embodiments employing electrical controls, the control electrodes or gates can be operated individually by making individually-driven connections to each electrode or gate.

Figure 13:
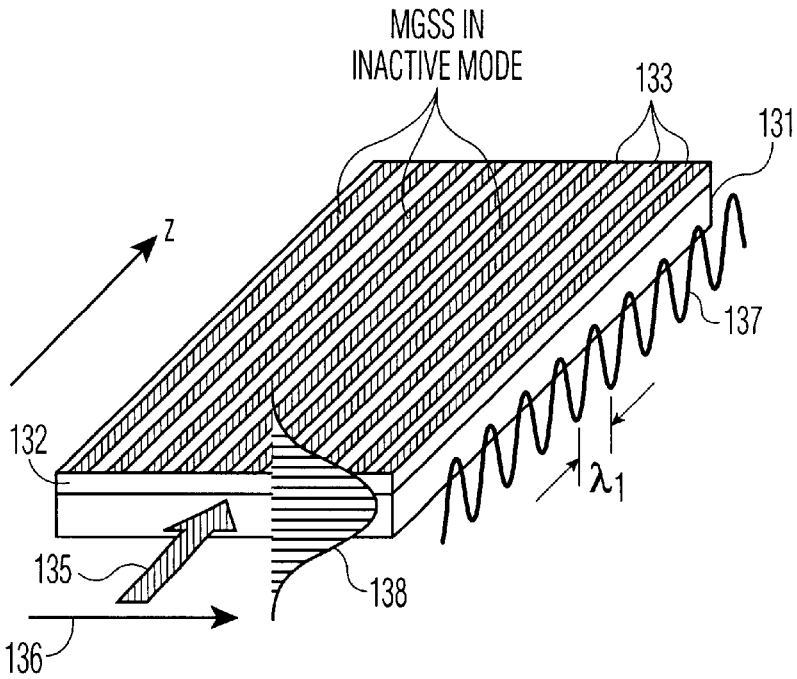
FIGS. 13 and 14 are schematic plan views of a planar dielectric waveguide using an MGSS to control the phase of a polarized wave in the waveguide.
Figure 14:
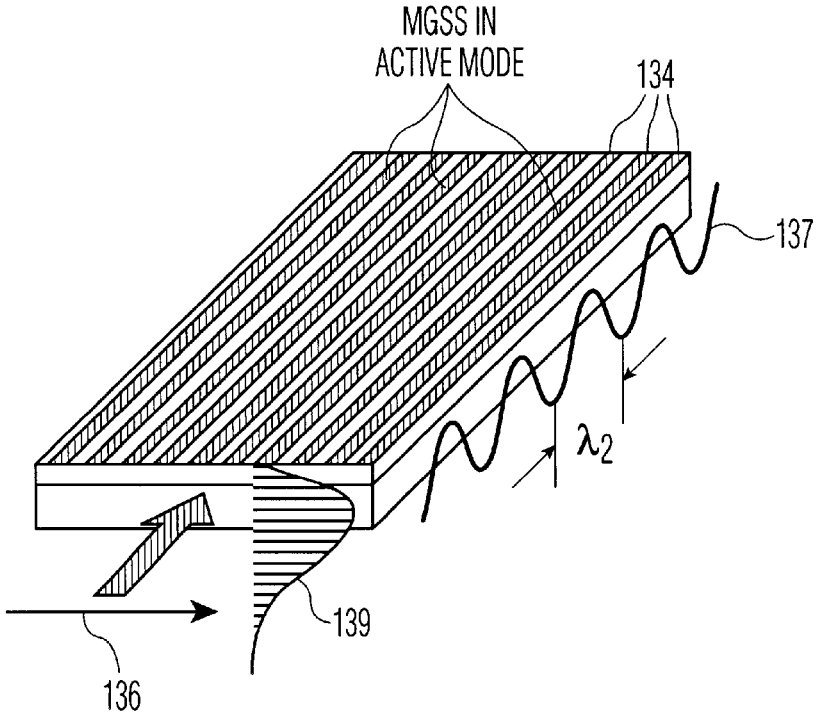

FIGS. 13 and 14 show the use of an MGSS to control the phase in a planar electric waveguide. The figures show a dielectric waveguide 131 with a semiconductor layer 132 and strips 133 of a grid where the strips are shown separated in FIG. 13 and are connected by electron-hole plasmas 134 in FIG. 14. A polarized electromagnetic wave represented by arrow 135 with an electric vector represented by arrow 136 launched into the waveguide has a waveform 137 with a wavelength λ1 and an energy distribution represented by bell-shaped curve 138. With the MGSS in the active (or connected) mode represented in FIG. 14, the energy distribution is changed as indicated by curve 139 and the wavelength is changed as indicated by λ2. The controls for the embodiment of FIGS. 13 and 14 may be electrical or optical as described hereinbefore.

Figure 15:
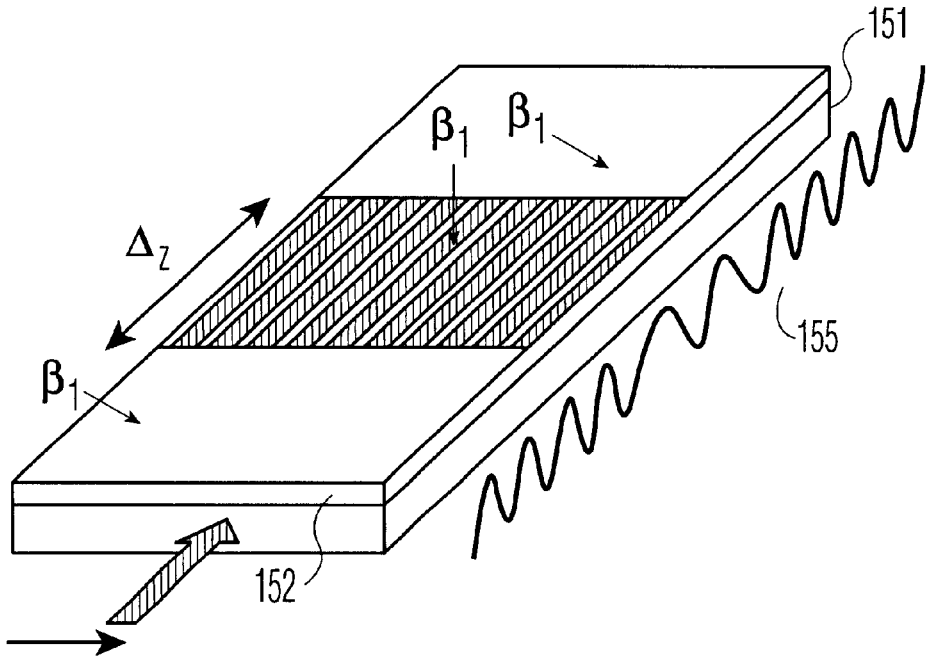
FIGS. 15 and 16 are schematic plan views of a planar dielectric waveguide using an MGSS as a wave shifter showing the reflection mode and the transmission mode respectively.
Figure 16:
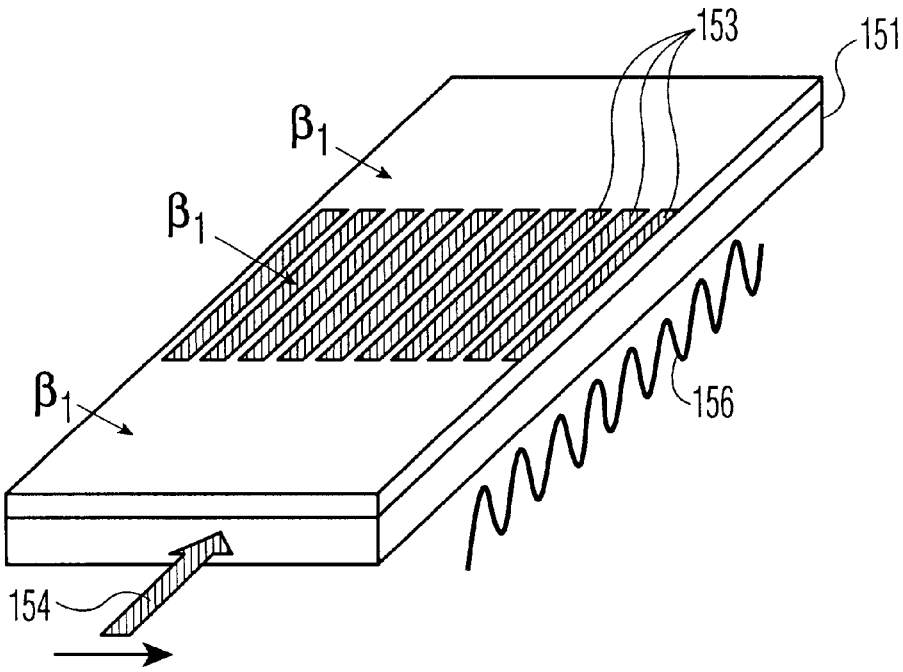

FIGS. 15 and 16 represent an embodiment operative as a phase shifter. The embodiment includes a dielectric waveguide 151 with a semiconductor layer 152 as was the case with the embodiment of FIGS. 13 and 14. But in this embodiment, the strips 153 of the grid occupy only a portion of the surface of the semiconductor layer. FIGS. 15 and 16 represent the strips connected by electron-hole plasmas and disconnected respectively. The change in waveform of a polarized wave (arrow 154) is understood by comparing waveforms 155 and 156 for the MGSS in the connected mode and in the disconnected mode of FIGS. 15 and 16, respectively.

Figure 17:
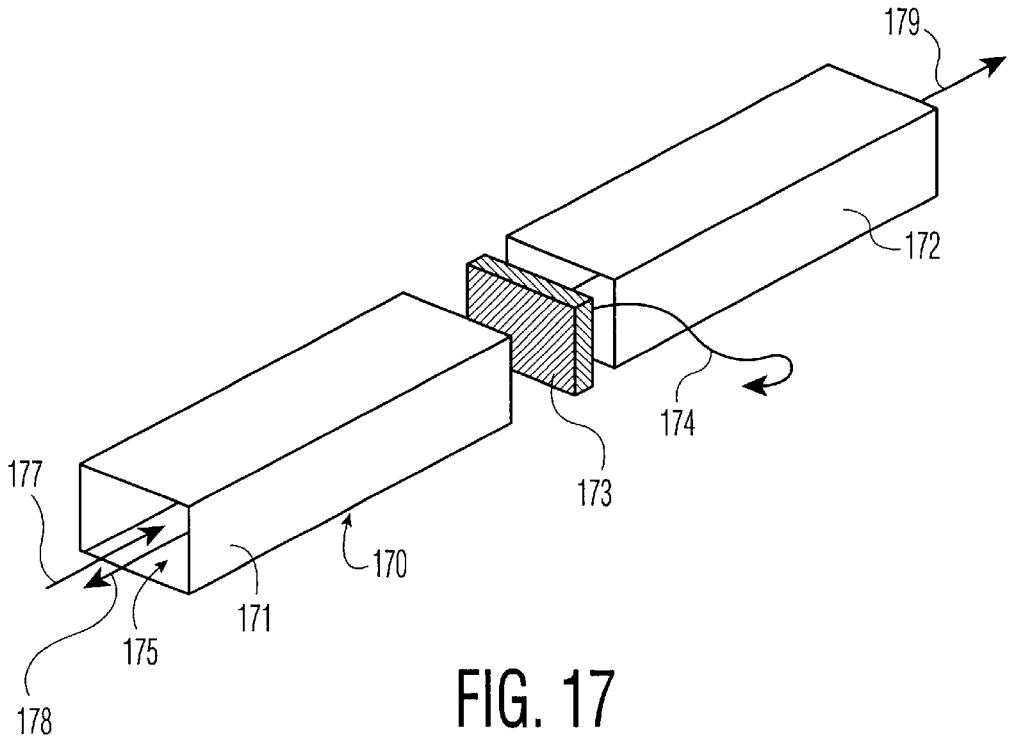
FIG. 17 is an exploded view of a waveguide employing an electrically-controlled MGSS as a switch.

FIG. 17 illustrates the use of an MGSS in a waveguide 170. The waveguide is shown in two sections 171 and 172 with the MGSS placed between the two sections. The MGSS is, illustratively assumed to be controlled electrically as indicated by electrical conductors 173 and 174. The MGSS is operative to reflect a wave introduced at an input end 175 of the waveguide or to transmit the wave depending on the presence or absence of an electron-hole plasma between the strips of the MGSS grid. The reflection mode is represented by oppositely-directed arrows 177 and 178. The transmitting mode is represented by arrow 179.

Figure 18:
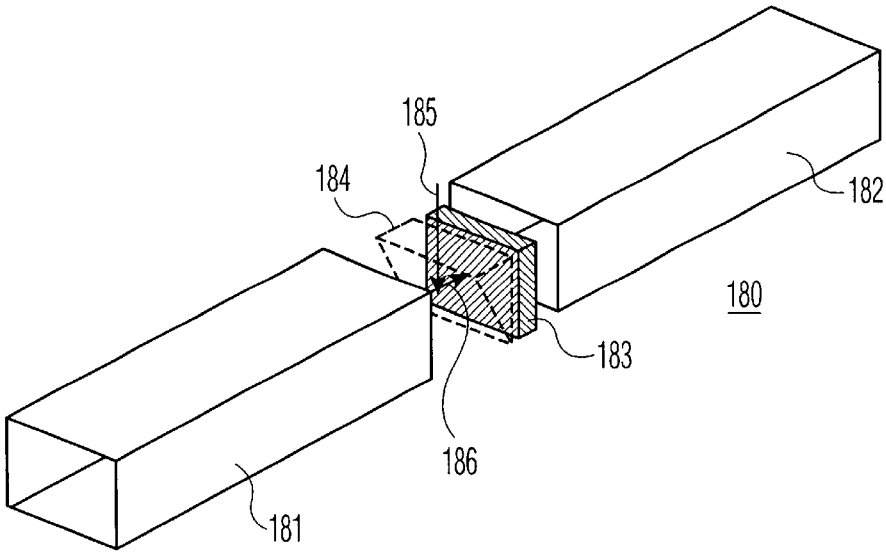
FIG. 18 is an exploded view of a waveguide employing an optically-controlled MGSS as a switch.

FIG. 18 illustrates a waveguide switch employing an MGSS which is optically controlled. Specifically, FIG. 18 shows a waveguide 180 separated into two sections 181 and 182 and including an MGSS 183 between the two sections. The apparatus also includes a dichvoic reflector (wedge-shaped, quartz prism) 184. Illumination downward (as viewed) in a direction indicated by arrow 185 is reflected off of the face of the wedge AS SHOWN BY ARROW 186 and is incident to MGSS 183. A wave launched into the waveguide in the manner of FIG. 17 is reflected or transmitted depending on the presence or absence of the illumination.

Figure 19:
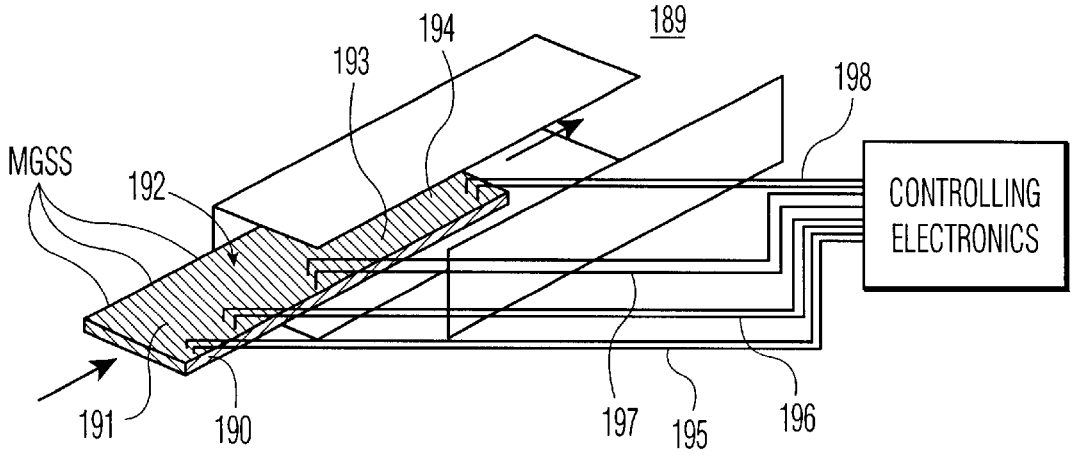
FIG. 19 is an exploded view of a waveguide employing an array of MGSSs of different length to provide an electrically controlled digital phase shifter operation.

FIG. 19 illustrates a waveguide, digital phase shifter which is electrically controlled. Specifically, FIG. 19 shows a waveguide 189, partially exploded to show the position of an MGSS 190 within it. The MGSS, in this embodiment, is of the type shown in FIGS. 15 and 16 except that there are several MGSS's 191, 192, 193 and 194, each independently activated electrically by four pairs of wires 195, 196, 197 and 198. Note that the lengths of the strips in the grids (MGSS) are different thus producing different shifts in a wave launched into the waveguide. Operation of each grid is as described in connection with FIGS. 15 and 16.

Figure 20:
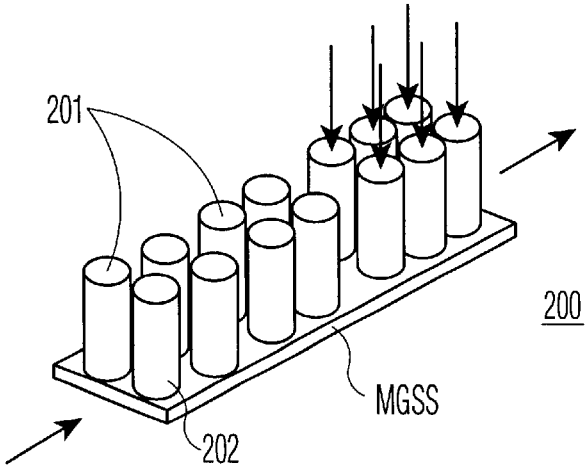
FIG. 20 is a schematic plan view of a portion of the embodiment of FIG. 19 showing optical control via selective illumination through optical fibers to provide an optically-controlled digital phase shifter.

FIG. 20 illustrates a waveguide digital shifter 200 which is optically controlled. The embodiment of FIG. 20 is a variation of the embodiment of FIG. 19 employing an MGSS as shown in FIG. 19. In the embodiment of FIG. 20 optical fibers 201 are coupled to the MGSS 202 and selective illumination of the MGSS sections is used to induce electron-hole plasmas rather than the wires of FIG. 19. In this case, the presence or absence of light in each fiber is controlled individually.

Figure 21:
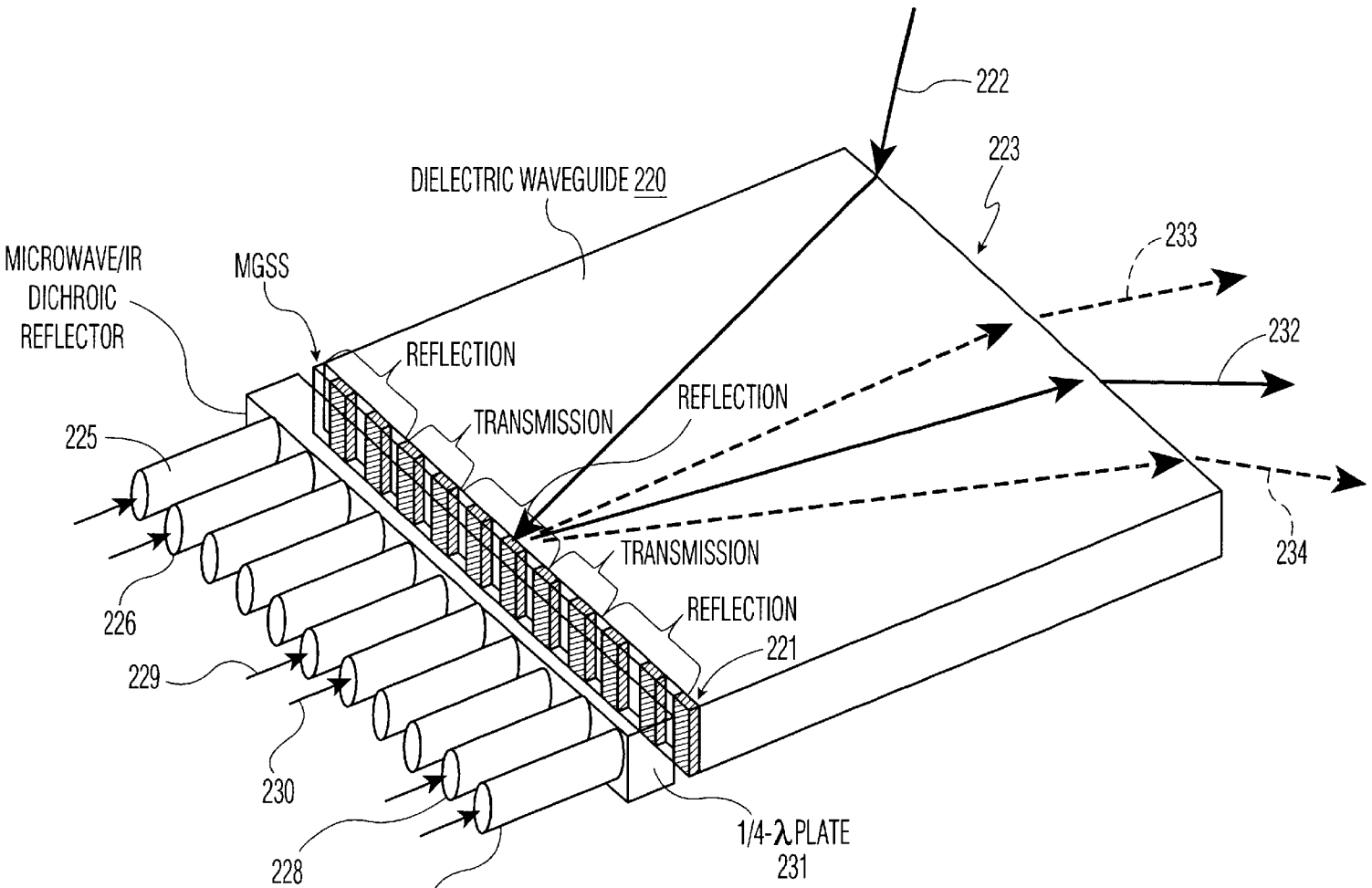
FIG. 21 is a schematic plan view of a smart reflection beam scanner employing an optically-controlled MGSS.

FIG. 21 illustrates a smart reflection beam scanner using an MGSS. The figure shows a dielectric waveguide 220 with an MGSS located at the back face 221 of the waveguide. The MGSS may be the MGSS of the embodiments shown in FIGS. 5, 6, 7 or 8. A millimeter wave (arrow 222) incident to the front face 223 of the waveguide is reflected or transmitted by different portions of the MGSS depending on the presence or absence of light on the portion. Light is directed at different portions of the MGSS by coupling optical fibers 224 to the MGSS and by selectively introducing light to the fibers. In the illustration light is introduced to the two fibers at each end of the linear array of fibers and to the two fibers in the middle of the array as indicated by arrows 225 and 226 and by arrows 227 and 228 for the fibers at the left and the right ends of the array as viewed. Arrows 229 and 230 represent the illumination of the fibers in the middle. The fibers are separated from the MGSS by a one quarter wave plate 231. The reflected portions of the incident millimeter wave (arrow 222) are indicated by arrow 232 and by broken arrows 233 and 234. The transmitted portions of the incident wave also are reflected but by the quarter wave plate which is operative as a dichvoic reflector. The reflected and the "transmitted" portions of the incident have distinct phases and after interference create an output beam (arrow 232) in a specific direction. The direction is a function of the periods of the reflected and the transmitting segments of the MGSS (i.e. the periodicity) of the illumination pattern. A change in the illumination pattern causes beam steering.

Figure 22:
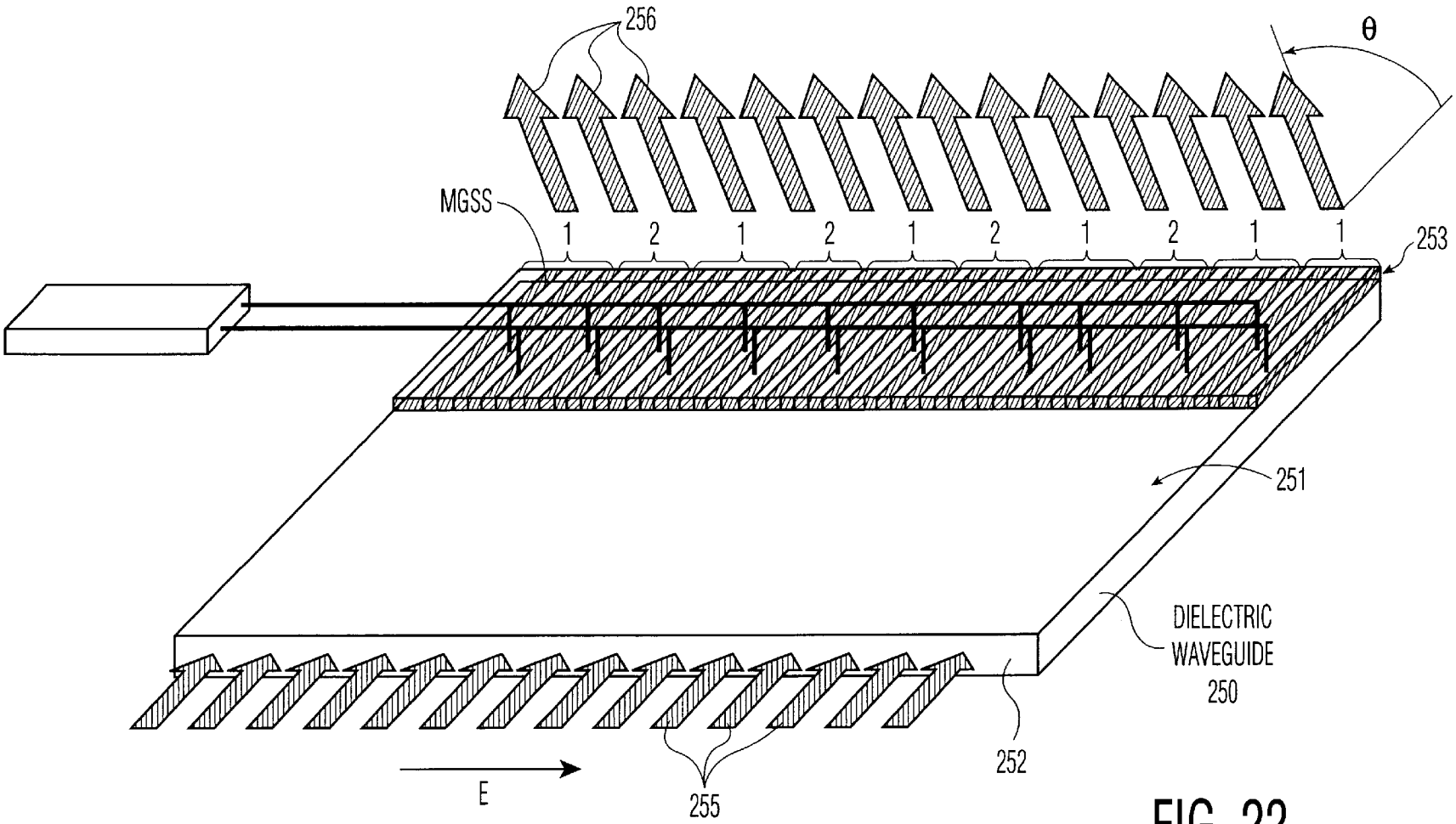
FIG. 22 is a schematic plan view of a phase-shifter beam scanner using an MGSS employing an electrical control.

FIG. 22 illustrates a phase shifter beam scanner using an MGSS. The figure shows a dielectric waveguide 250 having a top surface 251 and first and second edges 252 and 253. An MGSS, with strips aligned between the two edge, is formed on a portion of top surface 251 near edge 253. Portions of the MGSS indicated by brackets designated by a 1 are activated (i.e. optically but not shown). Inactive portions of the MGSS are indicated by brackets designated 2. An incident electromagnetic wave polarized in the plane of the waveguide as indicated by arrows 255 exits the waveguide in a direction determined by the periodicity of the active and inactive segments of the MGSS and indicated by arrows 256.

To be specific, a wave propagating in the waveguide passes the MGSS. The parts of the wave passing the inactive and the active portions of the MGSS accumulate different phase changes. The two parts interfere with one another to determine the direction of the outgoing beam. Beam steering is accomplished by changing the active and inactive segments of the MGSS.

What has been described hereinto is merely illustrative of the principles of this invention. Many other variations thereof may be implemented by those skilled in the art within the spirit and scope of the invention as claimed.

What is claimed is:

1. Apparatus comprising a substrate having a planar first surface, an array of more than three like electrically conducting parallel strips formed on said surface, said strips having spaces therebetween, said spaces including semiconductor spacers, said apparatus including first means for controllably injecting charge carriers into all of said semiconductor spacers.

2. Apparatus as in claim 1 also including means for directing polarized light at said array of strips.

3. Apparatus as in claim 2 wherein said substrate comprises a dielectric material and includes a semiconductor layer on said surface.

4. Apparatus as in claim 3 also including a planar dielectric waveguide, said waveguide being in energy coupled relationship with said layer and means for launching a polarized electromagnetic wave into said waveguide.

5. Apparatus as in claim 2 wherein said substrate comprises a high resistivity semiconductor wafer.

6. Apparatus as in claim 2 wherein said substrate comprises a wideband semiconductor substrate and said layer comprises a narrowband semiconductor layer.

7. Apparatus comprising a substrate having a planer first surface, a grid of more than three like electrically-conducting parallel strips formed on said surface and defining spaces therebetween, first means responsive to activation signals for providing an electrically-conducting medium at said surface between said strips, and second means for activating said first medium controllably.

8. Apparatus as in claim 7 wherein said substrate comprises a semiconductor material.

9. Apparatus as in claim 8 also including means for directing polarized light at said grid, said light having a wavelength $\lambda$ and said grid having line widths w and g which are smaller than $\lambda$.

10. Apparatus as in claim 7 wherein said substrate comprises a dielectric material with a semiconductor surface layer at said surface.

11. Apparatus as in claim 10 wherein said dielectric material comprises quartz and said semiconductor surface layer comprises silicon.

12. Apparatus as in claim 10 wherein said second means comprises a source of light for introducing an electron-hole plasma in said spaces.

13. Apparatus as in claim 7 wherein said substrate comprises a semiconductor wafer with a resistivity of about 10,000 ohms centimeters, said apparatus also including optical means for generating an electron-hole plasma between said strips.

14. Apparatus as in claim 7 wherein said substrate comprises a semiconductor heterojunction having a narrow band semiconductor surface layer on a wide band semiconductor substrate, said apparatus also including optical means for generating an electron-hole plasma between said strips.

15. Apparatus as in claim 14 wherein said surface layer comprises Ga As and said substrate compromises Ga Al As.

16. Apparatus as in claim 7 wherein said substrate comprises a high resistance semiconductor material, said substrate including a surface layer having a resistivity to form a schottky barrier and depletion layers at said spaces.

17. Apparatus as in claim 7 wherein said grid occupies a small section of said surface.

18. Apparatus as in claim 17 including a plurality of grids, each occupying a different section of said surface, said grids having different lengths.

19. Apparatus as in claim 7 in combination with a waveguide having a wave propagating path therein, said apparatus being positioned astride said path in a manner to transmit or reflect a wave propagating in said waveguide controllably.

20. A combination as in claim 19 wherein said means for activating includes a dichroic prism positioned to controllably direct light at said strips.

21. A combination including the apparatus as in claim 18 and a waveguide, said waveguide defining a propagation channel therewithin, said apparatus being positioned in said propagation channel, said combination including control electronics individually connected to different ones of said plurality of grids for controllably generating electron hole plasmas therein.

22. Apparatus as in claim 20 wherein said waveguide comprises first and second sections including an input end and an output end respectively, said apparatus being positioned between said first and second sections and being responsive to an optical control signal to transmit or reflect a wave entered at said input, said optical control including a prism also positioned between said sections at the input side of said reflector.

23. Apparatus as in claim 18 also including optical fibers having proximal and distal ends, said distal ends being positioned in energy-coupled relation to said plurality of grids and means for controllable directing light into said proximal ends.

24. Apparatus as in claim 7 wherein said substrate comprises a dielectric waveguide having first and second edge surfaces, said grid being formed on said first edge surface and including optical means for controllably injecting an electron-hole plasma in said spaces, said apparatus including means for launching a millimeter wave into said second edge surface at an angle to said first edge surface.

25. Apparatus as in claim 24 wherein said optical means comprises a microwave, dichroic infrared reflector adjacent said grid and a plurality of optical fibers having distal ends energy-coupled to said reflector.

26. Apparatus as in claim 18 wherein said optical fibers couple alternate sections of said grid and said apparatus including means for selectively directing light into different ones of said fibers for generating a pattern of reflected and transmitted light into said waveguide for providing an interference pattern with a wave propagating in said waveguide.

27. Apparatus comprising a substrate having a planar first surface, a grid of like electrically-conducting parallel strips formed on said surface and defining spaces therebetween, first means responsive to activation signals for providing an electrically-conducting medium at said surface between said strips, and second means for activating said first medium controllably wherein said substrate comprises a dielectric material and a semiconductor surface layer, said apparatus also including heavily doped P+ and N+ electrodes beneath said strips and means for controllably providing a forward bias between said electrodes for causing electron and hole injection between said strips.

28. Apparatus comprising a substrate having a planar first surface, a grid of like electrically-conducting parallel strips formed on said surface and defining spaces therebetween, first means responsive to activation signals for providing an electrically-conducting medium at said surface between said strips and second means for activating said first medium controllably including a high resistivity semiconductor substrate with a semiconductor surface layer having doped electrode areas formed therein, said apparatus including gates formed on said spaces, said apparatus including means for applying a voltage to said gates in a manner to generate an electron-hole plasma between said strips.

* * * * *